US006502542B1

(12) United States Patent
Stuart

(10) Patent No.: US 6,502,542 B1
(45) Date of Patent: Jan. 7, 2003

(54) ELECTRONICALLY CONTROLLED THROTTLE VALVE WITH LIMP HOME MECHANISM

(75) Inventor: Philip Edward Arthur Stuart, Chatham (CA)

(73) Assignee: Siemens VDO Automotive Inc., Tilbury (CA)

( * ) Notice: Subject to any disclaimer, the term of this patent is extended or adjusted under 35 U.S.C. 154(b) by 0 days.

(21) Appl. No.: 09/705,174

(22) Filed: Nov. 2, 2000

Related U.S. Application Data

(60) Provisional application No. 60/163,983, filed on Nov. 8, 1999.

(51) Int. Cl.[7] ..... F02D 9/10

(52) U.S. Cl. ..... 123/337; 123/399

(58) Field of Search ..... 123/337, 339.15, 123/399; 251/305

(56) References Cited

U.S. PATENT DOCUMENTS

| | | | | |
|---|---|---|---|---|
| 3,442,489 A | * | 5/1969 | Cary et al. | 251/305 |
| 3,960,177 A | | 6/1976 | Baumann | |
| 4,480,815 A | | 11/1984 | Kreij | |
| 4,489,917 A | * | 12/1984 | Baumann | 251/305 |
| 5,146,887 A | * | 9/1992 | Gluchowski et al. | 123/336 |
| 5,735,243 A | | 4/1998 | Asai et al. | |
| 5,752,484 A | | 5/1998 | Apel et al. | |
| 6,003,490 A | * | 12/1999 | Kihara et al. | 123/337 |
| 6,037,730 A | * | 3/2000 | Turner et al. | 123/396 |

FOREIGN PATENT DOCUMENTS

| | | |
|---|---|---|
| EP | 0459 509 | 12/1991 |

* cited by examiner

*Primary Examiner*—Gene Mancene
*Assistant Examiner*—Arnold Castro

(57) ABSTRACT

The subject invention is a linkage assembly for an electronically controlled throttle (ETC) that provides for the precise setting of a limp home engine speed for a vehicle. Essentially a controlled amount of movement is attained between a closed position and a limp home throttle position. A throttle valve is attached to a first shaft and rotates to regulate air intake. The first shaft is attached to a sector gear. The sector gear is driven by the ETC. A stop bracket limits the amount that the sector gear can close the throttle valve. The stop bracket defines an opening, and a cam is disposed within the opening. A spring biases the stop bracket against the cam. Normally, the ETC can overcome the spring and the stop bracket is forced against the cam such that stop bracket contacts the cam to define a closed throttle position. Of course, when operational the ETC can drive the valve to open position as demanded by the vehicle. The limp home engine speed is set by a preset by the difference between the length of the opening of the stop bracket and a width of the cam. If the ETC becomes disabled, there is not enough force to overcome the spring and move the sector gear to the closed throttle position, instead the sector gear remains at the second stop position to provide the limp home engine idle speed that allows a driver to sufficiently maneuver the vehicle.

14 Claims, 2 Drawing Sheets

ELECTRONICALLY CONTROLLED THROTTLE VALVE WITH LIMP HOME MECHANISM

This application claims priority to provisional application Ser. No. 60/163,983 filed on Nov. 8, 1999.

BACKGROUND OF THE INVENTION

This application discloses an improved limp home feature for an electronic throttle control.

An electronic throttle control (ETC) replaces the mechanical throttle linkage to control the position of the throttle valve. The throttle valve actuated by the ETC is opened proportionally according to signals received from a sensor placed on an accelerator pedal. The ETC opens the throttle valve proportionally to movement of the accelerator pedal.

A typical ETC will be mounted to a throttle body. The throttle body includes an airflow passage though which air is brought into the engine. The throttle valve is disposed within the airflow passage and attached to a shaft for rotation about an axis to regulate the intake of air. A closed throttle position is set to provide a minimum airflow requirement for an engine, to keep an engine at or near a stall condition.

A limp home throttle position is set for when the ETC is disabled, and provides an engine speed that will produce enough power that can easily be controlled by a driver. The intent of the limp home throttle valve position is to provide the driver with sufficient power to maneuver the vehicle.

Current mechanisms for attaining the limp home throttle valve position include double spring arrangements that are balanced against each other to provide the proper throttle valve position upon disablement of the ETC. The double spring arrangement typically includes one spring to close the throttle valve acting against another spring to open the throttle valve to the limp home throttle valve position. The double spring arrangement must be carefully balanced to attain the desired amount of throttle valve opening for the limp home position. Further, the use of opposing springs creates an inconsistent limp home throttle position because the balance between the springs may change over time. The limp home position must be set precisely, because a limp home engine speed that is too low will not provide the necessary engine power to maneuver the vehicle. Alternatively, too high an engine speed may create a sensation in the driver of being out of control of the vehicle.

For these reasons it is desirable and necessary to provide a simple mechanism that provides for reliable setting and preservation of the limp home throttle valve position for an ETC.

SUMMARY OF THE INVENTION

The subject invention is an electronic throttle control with a linkage assembly that provides for the setting of a limp home throttle valve position. Essentially, the subject invention eliminates the double spring arrangement of the prior art by providing a self-closing throttle valve.

The throttle valve includes an airfoil shape utilizing the flow of air through the throttle body to produce a closing force, thereby eliminating the need for a throttle return spring. The throttle valve also includes differential areas that create a net force that rotates the throttle valve towards the closed position. The throttle valve arrangement allows a precise amount of throttle movement from a closed throttle position to the limp home throttle position when the ETC motor is disabled. A throttle valve is attached to a shaft within the airflow passage and rotates about an axis to regulate air intake. An electric motor drives a lever rigidly attached to the shaft through a linkage assembly. A biasing member attached to the shaft biases the throttle valve toward the closed position when the throttle valve is at or near the open position. A second biasing member attached to the sector gear biases the throttle valve to a limp home position when the electric motor is disabled.

The subject invention overcomes the deficiencies of the prior art by providing a simple, reliable and cost effective linkage assembly that provides for the ETC limp home throttle positions.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
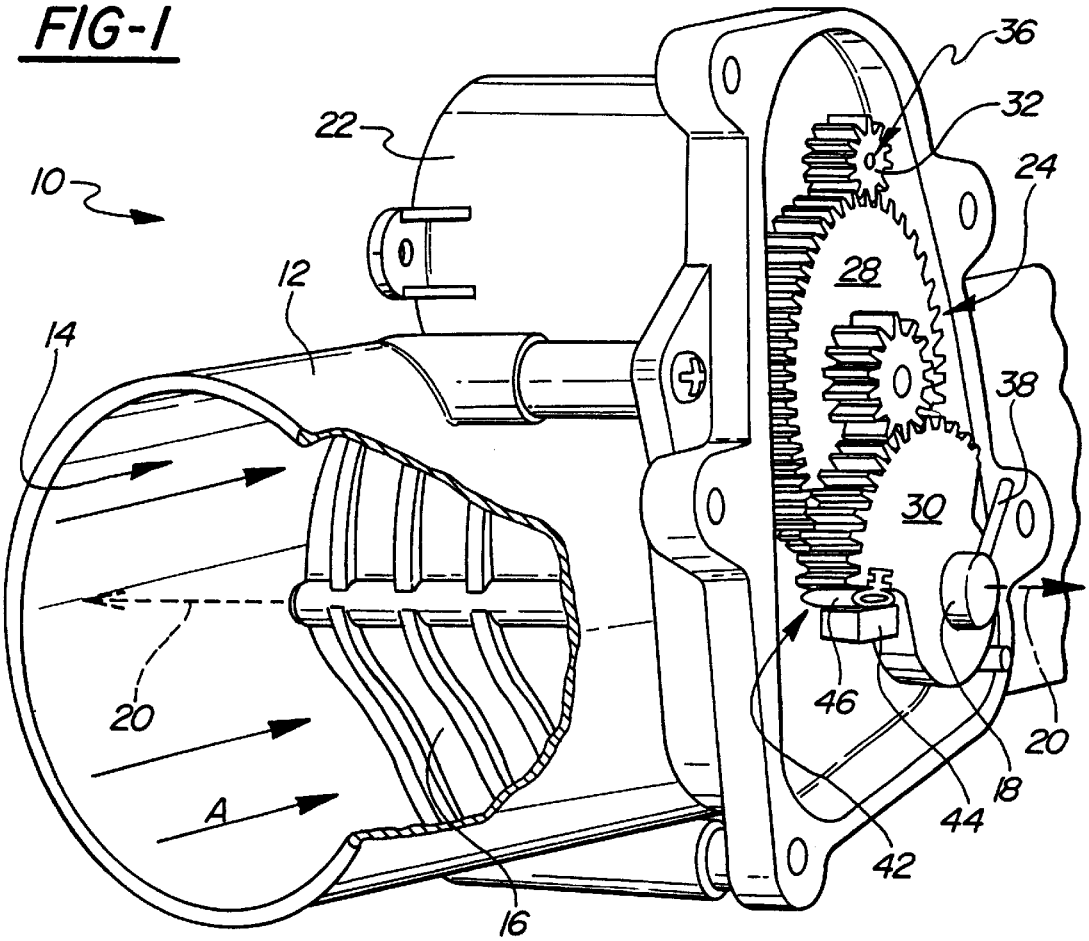
FIG. 1 is a perspective view of an electronically controlled throttle body with a cutaway showing the throttle valve.

Referring to the Figures, wherein like numerals indicate like or corresponding parts throughout the several views, where the subject invention is an electronically controlled throttle assembly 10 with linkage that provides for a limp home throttle valve position. The electronically controlled throttle assembly 10 is shown in FIG. 1 and includes a throttle body 12 defining an airflow passage 14. A throttle valve 16 is fixed to a shaft 18 to rotate the throttle valve 14 about an axis 20. An electric motor 22 drives the shaft 16 through a linkage assembly 24. The airflow passage 14 of the throttle body 12 provides for intake of air into an engine of a motor vehicle. The throttle valve 16 rotates about the axis 20 to regulate the flow of air through the airflow passage 14 between open and closed positions.

Figure 2:
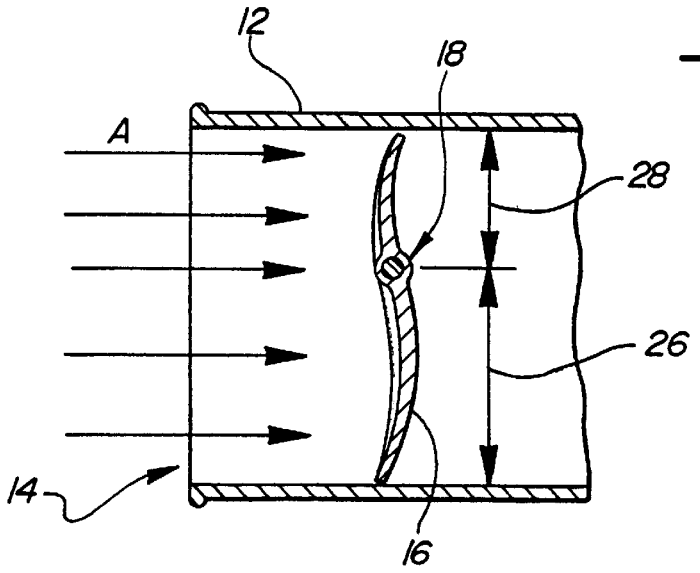
FIG. 2 is a cross-sectional view of the throttle valve.

Referring to FIGS. 1 and 2, the intake of air through the airflow passage 14 creates airflow in the direction indicated by arrows A and the throttle valve 16 includes an airfoil shape such that the airflow across the throttle valve 16 will tend to close the throttle valve 16. FIG. 2 shows the cross-section of the throttle valve 16. The throttle valve 16 includes first and second sections 26,28. The sections 26,28 are arranged on opposite sides of the axis 20. Each of the sections 26,28 are curved into an airfoil shape to create a closing force. The sections 26,28 are curved in opposing directions to create the closing force that rotates the throttle valve about the axis 20 toward the closed position.

In addition to the airflow shape of the throttle valve 16, the first section 26 of the airfoil includes an area greater than the second section 28. Airflow through the airflow passage 14 applies a pressure force to the throttle valve 14. The difference in areas between the first and second sections 26,28 provides a net pressure force that rotates the throttle valve 14 toward the closed position. One result of this configuration is that the need for a throttle return spring is minimized or reduced because the throttle valve 14 configuration, described above will be biased toward the closed position.

Figure 3:
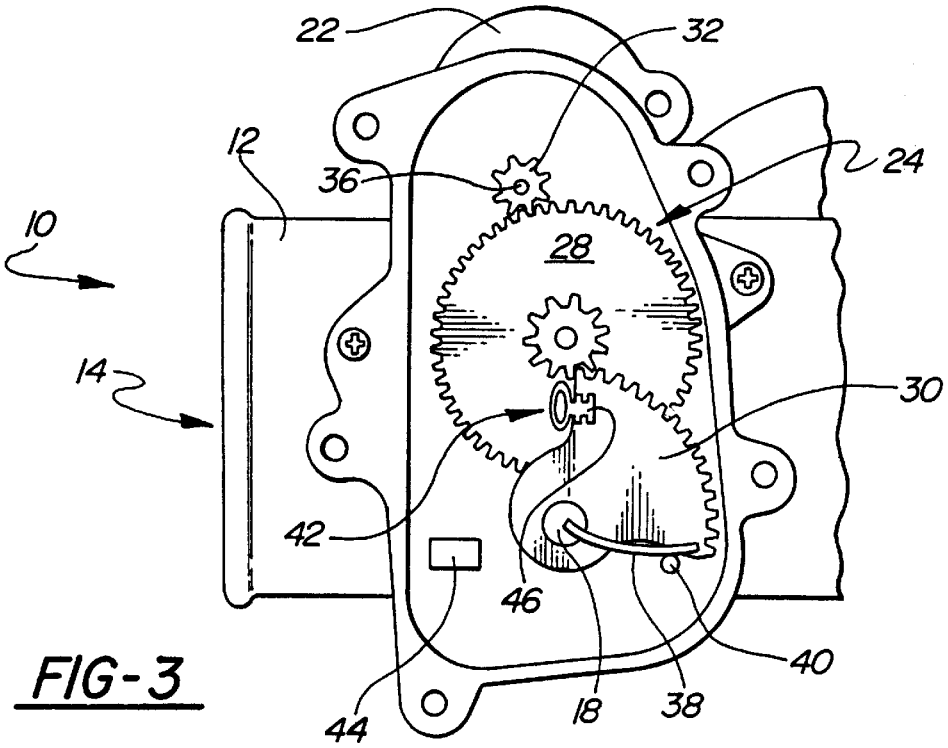
FIG. 3 is a side view of the throttle linkage in the open throttle position.

Referring to FIG. 3, the linkage assembly 24 of the subject invention includes a sector gear 30 driven by the electric motor 22 through at least one drive gear. Specifically, a first gear 32 is mounted on a shaft 36, drives a second drive gear 28, which in turn drives the sector gear 30 to rotate the shaft 18. The linkage assembly 24 shown in FIG. 3 is shown in the fully open position. The electric motor 22 drives the drive gears 30,32, and 34 rotate the shaft and thereby the throttle valve 16 to the fully open position. The linkage assembly 24 includes a first biasing member 38 attached to the shaft 36. The first biasing member 38 engages a first stop 40 when the throttle valve is in the fully open position to bias the throttle valve 16 towards the closed position. The first biasing member 38 is preferably a plastic rod engaged to bias the throttle valve 14 towards the open throttle position only when the throttle valve 16 is at or near the fully open throttle position. Rotating the throttle valve 16 away from the open position disengages the first biasing member 38 from the first stop 40.

The first biasing member 38 serves to kick the throttle valve 16 away from the open position to aid in closing of the throttle valve 16. Moving the throttle valve 16 from the fully open position to an intermediate open position, allows the airfoil shaped throttle valve 14 and the differing areas of the first and second sections 26,28 to further drive the throttle valve 14 toward the closed throttle position. When the electric motor 22 is engaged to rotate the throttle valve 14 between the open and closed positions. Upon disablement of the electric motor 22, the first biasing member 38 and the airfoil shaped throttle valve 16 act force rotation of the throttle valve 14 towards the closed position.

Figure 4:
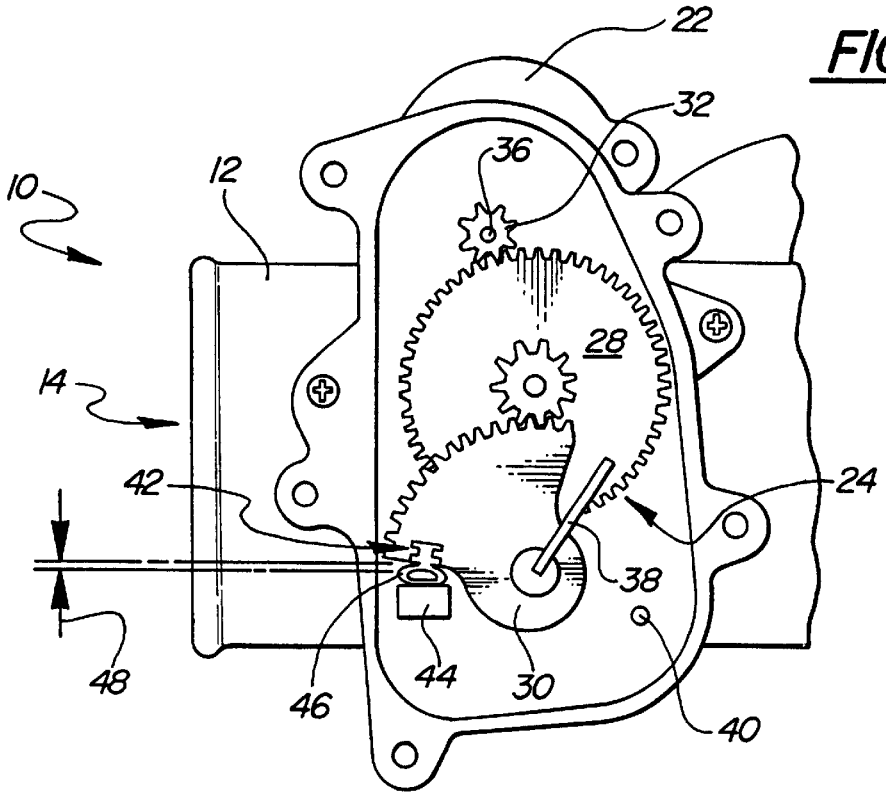
FIG. 4 is a side view of the throttle linkage in the closed throttle position.

The linkage assembly 24 in FIG. 4 is shown in the closed position. The linkage assembly 24 includes a second biasing member 42 to position the throttle valve 16 into a limp home position. The second biasing member 42 is attached to the sector gear 30 and engages a second stop 44 when the throttle valve 16 is moved to the closed position. The second biasing member 42 is preferably a plastic circle spring 46. The circle spring 46 provides a non-linear biasing force on the sector gear 30 to bias the throttle valve 16 to the limp home position. Normally, the electric motor will overcome the biasing force exerted by the circle spring 46 and drive the throttle valve 16 to the closed position. Upon disablement of the electric motor 22 the circle spring 46 overcomes the forces exerted by the airfoil shaped throttle valve 16 to move the throttle valve 16 to the limp home position.

The circle spring 46 is preferably constructed from plastic. A thickness 48 of the circle spring 46 determines the magnitude of the biasing force exerted on the throttle valve 16. The biasing force of the circle spring 46 is balanced against the forces created by the configuration of the throttle valve 16 such that the throttle valve 16 opens to the limp home position. It should be understood that the second biasing member may be of any type known in the art. Specifically, it is within the contemplation of this invention that the second biasing member may be a solid piece of rubber sized to provide for the proper opening of the throttle valve to attain the limp home throttle valve position.

In operation, the electric motor 22 drives the sector gear 30 through the linkage assembly 24 and thereby drives the throttle valve 16 between the open position and the closed position. At the open position the first biasing member 38 engages the first stop 40 to bias the throttle valve toward the closed position. The electric motor 22 is able to drive the throttle valve 16 against the biasing force of the first biasing member 38 to the open position. During operation, the first biasing member 38 acts to assist the electric motor 22 to rotate the throttle valve 16 from the open position. Further, the shape and configuration of the throttle valve 16 aids the electric motor 22 in moving the throttle valve 16 to the closed position. The closed position may only be attained with the added force of the electric motor 22.

Without the force of the electric motor 22, the force of the circle spring 46 may not be overcome. Therefore upon disablement of the electric motor 22, the first biasing member 38 kicks the throttle valve 16 towards the closed position, the difference between areas of the first and second sections 26, 28 and the airfoil shape further drive the throttle valve 16 toward the closed position. The throttle valve 16 is prevented from reaching the closed position and acts against the closing forces to move the throttle valve 16 to the limp home position. The limp home position provides sufficient engine power to the motor vehicle to maneuver the vehicle.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. An electronically controlled throttle valve assembly for a motor vehicle comprising;

a throttle body defining an air flow passage;

a throttle valve for regulating air through said air flow passage movable between an open position and a closed position, said throttle valve having first and second areas and said first area is greater than said second area;

a shaft fixed to rotate said throttle valve about an axis;

said first and second areas arranged on opposite sides of said axis and the intake of air causes a pressure force on said first and second areas such that said throttle valve is rotated about said axis towards said closed position.

2. The assembly of claim 1, wherein said throttle valve includes an airfoil shape, such that the intake of air causes a lift force to rotate said throttle valve towards said closed position.

3. The assembly of claim 1, further including a first biasing member attached to said shaft, said first biasing member engaged when said throttle valve is in said fully open position to bias said throttle valve towards a closed position.

4. The assembly as in claim 3, wherein said first biasing member is a linear plastic rod extending from said shaft such that in said open position said plastic rod provides a biasing force towards said closed position.

5. The assembly of claim 1, further including a lever attached to rotate said shaft and a second biasing member attached to said lever, said second biasing member engaged when said throttle valve is in said closed position to bias said throttle valve towards said filly open position.

6. The assembly as in claim 5, further including an electric motor to drive said lever to rotate said shaft and said throttle valve between said open and closed positions.

7. The assembly as in claim 6, wherein said second biasing member biases said throttle valve toward said fully open position to a limp home throttle valve position, and said limp home throttle valve position is attained when said electric motor is disabled and cannot overcome said second biasing member.

8. The assembly as in claim 5, wherein said second biasing member is a circular plastic spring.

9. An electronically controlled throttle valve assembly for a motor vehicle comprising;

a throttle body defining an air flow passage;

a throttle valve having an airfoil shape for regulating intake of air movable between an open and closed position;

a shaft fixed to rotate said throttle valve about an axis;

said airfoil shape of said throttle valve creating a lift force to rotate said throttle valve about said axis towards said closed position.

10. The assembly of claim 9, wherein said throttle valve includes first and second areas and said first area is greater than said second area, said first and second areas arranged on opposite sides of said axis and the intake of air causes a pressure force on each of said areas such that said throttle valve is rotated towards a closed position.

11. The assembly of claim 10, further including a first biasing member engaged when said throttle valve in said fully open position and biases said throttle valve toward said closed position.

12. The assembly of claim 10, further including a lever attached to rotate said shaft, and a second biasing member attached to said lever, said biasing member engaged when said throttle valve is in said closed position to bias said throttle valve toward said open position to a limp home position such that the engine provides sufficient power to maneuver the motor vehicle.

13. The assembly of claim 12, further including a drive to rotate said lever between said open and closed positions.

14. The assembly of claim 13, wherein said second biasing member is a circular spring, said circular spring biases said throttle valve from said closed position to said limp home position upon disablement of said drive.

* * * * *